US006472994B1

(12) United States Patent
Tator

(10) Patent No.: US 6,472,994 B1
(45) Date of Patent: Oct. 29, 2002

(54) EMERGENCY GUIDANCE SYSTEM

(76) Inventor: Reed Tator, 6822 Hazeltine, Van Nuys, CA (US) 91405

( * ) Notice: Subject to any disclaimer, the term of this patent is extended or adjusted under 35 U.S.C. 154(b) by 0 days.

(21) Appl. No.: 09/576,495

(22) Filed: May 23, 2000

Related U.S. Application Data

(63) Continuation of application No. 09/192,420, filed on Nov. 16, 1998, now abandoned.

(51) Int. Cl.[7] ..... G08B 5/00

(52) U.S. Cl. ..... 340/815.4; 340/332; 340/693.2; 40/595

(58) Field of Search ..... 340/815.4, 815.78, 340/332, 693.2; 40/595, 594, 584

(56) References Cited

U.S. PATENT DOCUMENTS 4,173,035 A * 10/1979 Hoyt ..... 362/249
4,401,050 A * 8/1983 Britt et al. ..... 116/205
4,801,928 A * 1/1989 Minter ..... 340/691
5,151,679 A * 9/1992 Dimmick ..... 340/326
5,775,016 A * 7/1998 Chien ..... 40/544
6,025,773 A * 2/2000 Bresnan ..... 340/407.1
6,142,648 A * 11/2000 Logan et al. ..... 362/234

* cited by examiner

*Primary Examiner*—Benjamin C. Lee
*Assistant Examiner*—Phung Nguyen
(74) *Attorney, Agent, or Firm*—Joseph E. Mueth

(57) ABSTRACT

A line of illuminated electrically powered exit indicators, each having a power backup is mounted on one surface of a non-conductive tape-like support which is flexible enough to be formed into a roll and bend around corners. The exit indicators and the electric circuits are mounted on one surface of the support. A strong adhesive is applied to the opposite surface of the support so that the exit indicators can be easily attached by the adhesive to surfaces of corridors. The tape-like support is provided with a device which permits the tape-like support to be easily unrolled without stressing the electric circuits on the surface of the tape-like support roll.

2 Claims, 1 Drawing Sheet

EMERGENCY GUIDANCE SYSTEM

CLAIM OF PRIORITY

This application is a continuation of U.S. patent application Ser. No. 09/192,420, filed on Nov. 16, 1998, now abandoned.

This invention relates to an emergency guidance system for use in the hallways of multi-storied office or hotel buildings or passageways in vessels having many decks and parallel corridors.

FEDERALLLY SPONSORED RESEARCH

No part of this invention was developed with the aid of any federally sponsored research and development.

BACKGROUND OF THE INVENTION

Many large structures have parallel corridors and multiple floors or decks. People occupying these structures are vulnerable to fire, earthquakes, explosions or other forces because the exits may be hard to find in case of emergency. To safely evacuate the occupants, the corridors are usually provided with illuminated exit indicators that are placed in separate locations above the exit doors. However in large structures with many corridors or passageways, the exit indicators may be obscured by smoke and fire.

Since corridors and passageways vary in length, it would be desirable to provide a variable length emergency guidance system which can be easily and quickly installed and secured by a strong adhesive to a surface of the corridor. This suggests mounting an electrical guidance system on a rolled tape-like non-conductive support and using an adhesive to secure the guidance system to a surface of a corridor. But for this to work, the tape-like non-conductive support must be easily unrolled without stressing the electrical guidance system.

To overcome the problems inherent in the present practice, the inventor proposes to provide an easily installed emergency guidance system consisting of a tape-like non-conductive support having opposed surfaces. The tape-like non-conductive support would be flexible enough to be formed into a tape-like roll for easy transportation and installation. Small illuminated electrical exit indicators electrically and physically connected to each other are mounted in spaced relationship to each other on one surface of the tape-like non-conductive support to form a line of indicators leading to an exit when the tape-like support is unrolled. A strong adhesive is provided on the opposite surface of the tape-like non-conductive support so the adhesive surface of the tape-like non-conductive support can strongly adhere to walls of the corridors in the structure. The intent is that a guidance system of any length can be quickly installed on various corridors.

However if the tape-like non-conductive support is to be formed into a tape-like roll for easy transportation, storage, and installation, care is required because the electric circuits of the exit indicators which are mounted on one surface of the tape are comparatively fragile. If the exit indicators are subjected to stress caused by the strong adhesive when forcibly unrolling the tape-like support, the electrical connections may fail, affecting the guidance system.

These illuminated exit indicators are powered both by the main structure power source and by individual back up batteries connected to each illuminated exit indicator, so if there is a failure of the main structure power source, it will not affect the operation of the remaining illuminated exit indicators.

With this arrangement any number of exit indicators can be pre-installed on one surface of a tape-like non-conductive support and tested before the tape-like non-conductive support and exit indicators are installed on a corridor surface. As a result the cost of installation and testing the exit indicators is greatly reduced.

What is needed therefore, and comprises an important object of this invention is to provide a line of illuminated electrically and physically connected exit indicators for a structure where the exit indicators are mounted on an elongated tape-like non-conductive support in spaced relationship to each other and where each exit indicator contains its own light source and a back up battery, and can be connected to and powered by a main power source for the structure.

Another object of this invention is to provide exit indicators mounted on a tape-like non-conductive support where each exit indicator contains a light source and a back up battery.

Yet another object of this invention is to provide a number of electrically and physically connected exit indicators mounted in spaced relationship to each other on a tape-like non-conductive support having opposed surfaces wherein one surface of the tape-like non-conductive support is coated with a strong adhesive for attachment to a corridor surface and the exit indicators are mounted on the opposite surface and wherein the tape-like non-conductive support can be easily unrolled.

Still another object of this invention is to provide a number of electrically and physically connected exit indicators mounted in spaced relationship on one surface of a tape-like non-conductive support flexible enough to be formed into a roll, where each exit indicator has a light source, and the tape-like non-conductive support roll can be easily unrolled without stressing the electrical and physically connected electric circuits on the tape-like non-conductive support to form a line of illuminated lights.

Yet another object of this invention is to mount a number of exit indicators on one surface of a roll which has a strong adhesive for attachment to a corridor surface mounted on the opposite surface so when the tape-like non-conductive support roll is unrolled it forms a line of exit indicators which can be stuck by the adhesive to a surface of a corridor in the main structure.

Still another object of this invention is to provide a convenient and inexpensive way to secure a line of exit indicators to a surface of a corridor.

These and other objects of this invention will become more apparent when better understood in the light of the accompanying specification and drawings wherein.

DETAILED DESCRIPTION

Figure 1:
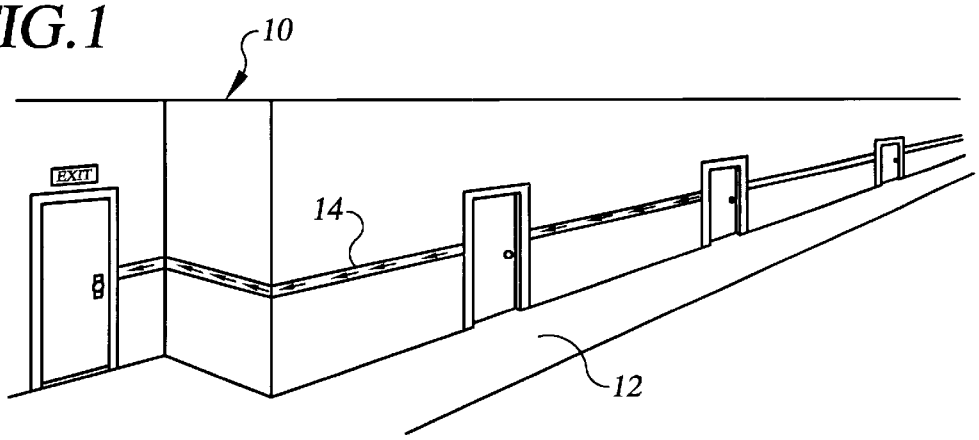
FIG. 1 is a perspective view of a cutaway of a portion of one floor of a large structure having a plurality of parallel corridors and floors (not shown), disclosing one corridor and a line or band of illuminated exit indicators adhering to a corridor surface leading to an exit.
Figure 5:
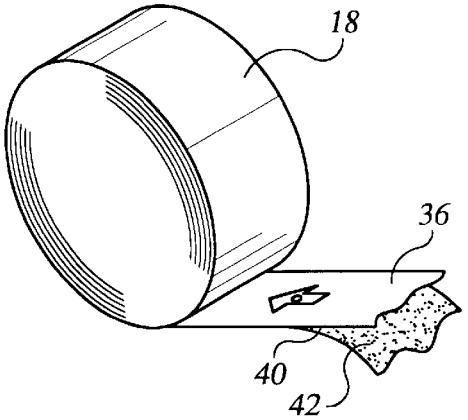
FIG. 5 is a perspective view of a tape-like non-conductive support roll of exit indicators showing the adhesive surface covered by a material that adheres only slightly to the adhesive surface, and which is in the process of being peeled away from the adhesive surface.

Referring to FIG. 1 of the drawing, a portion of a building 10 having many floors and parallel corridors (not shown) discloses a corridor 12 with a line of illuminated a exit indicators 14 that are adhering to a surface of a corridor leading to an exit. The exit indicators are mounted in spaced relationship on one surface 19 of a preferably tape-like non-conductive tape-like non-conductive support 18, see FIG. 3. As shown in FIG. 5, The tape-like non-conductive support 18 may be flexible enough to be formed into a roll so that the tape-like non-conductive support can follow surface corners of a corridor or flights of stairs.

The electric circuit 16 for each exit indicator 14 has a back up battery 20 connected in parallel by trunk lines 22 and 24 to a suitable resistor 26 and preferably a light emitting diode 28, or another suitable illuminating device. In this way the requirements of the structure controls the size of the tape-like non-conductive support roll and the number of exit indicators mounted on it.

A transformer 30 (not completely shown) connected to the main building power source is connected to the trunk lines 22 and 24 through a suitable rectifying diode 32. With this arrangement all the batteries in each circuit are kept charged as long as the electric circuits mounted on the tape-like non-conductive support 18 are connected to the main power source of the building. The voltage across trunk lines 22 and 24 is sufficient to turn on the light emitting diodes 28. In addition, the batteries 20 are selected so if the main power source fails; the batteries have enough voltage to keep the light emitting diodes 28 in each electric circuit illuminated.

Figure 3:
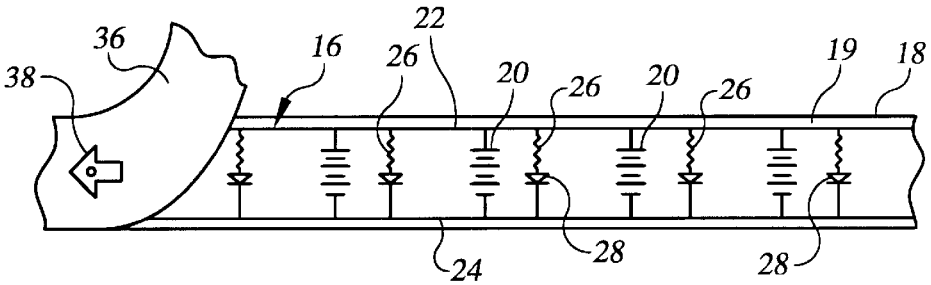
FIG. 3 is a view of the circuit diagram of the line of exit indicators mounted on a tape-like non-conductive support and protected by the transparent or translucent covering shown in FIG. 2
Figure 4:
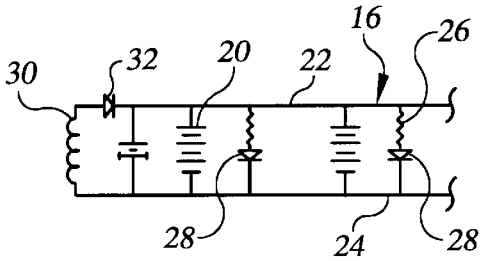
FIG. 4 shows the electrical circuits for the exit indicators connected to the power source of the structure.

With this arrangement, any event that destroys the main power source or severs the line of electric circuits shown in FIG. 3 will still leave the light emitting diodes illuminated so people in the structure can follow them to the exit.

To secure the exit indicators 14 to a surface of a corridor, the tape-like non-conductive support 18 has a strong adhesive applied to the tape-like non-conductive support surface 40 opposite the surface 19 on which the exit indictors are mounted, see FIGS. 3 and 5. This surface is covered by a material 42 that does not adhere strongly to the adhesive on the roll 18. This permits this material to be easily pulled away from the adhesive thereby avoiding stress on the electric circuits on the tape-like non-conductive support and permits the tape-like non-conductive support to be easily unrolled and applied by the adhesive to the walls or other surfaces of a corridor in the structure. In this way a line of exit indicators can be quickly and easily attached to surfaces on all the corridors in the structure.

Figure 2:
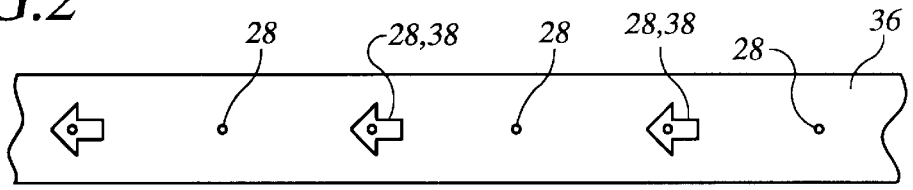
FIG. 2 is a plan view of a transparent or translucent covering protecting the exit indicators on the tape-like non-conductive-support with indicia on the covering pointing the way to an exit to the structure.

The exit indicators 14 are covered by a protective material 36 which is, at least, partly translucent or transparent, see FIG. 2. Markings, such as arrows 38 are formed on this protective material and illuminated by the light source to indicate the direction to the exit.

It is also noted that roll can be cut to any length depending on the physical requirements of the structure. If this is done, the trunk lines 22 and 24 can be connected to the transformer 30 by any suitable means so that the light source in the clipped portion of the roll will still operate.

With the arrangement described so far, once the exit indicators on the tape-like non-conductive support are connected to the main power source, if some explosion or earthquake cuts one or more sections of the tape-like non-conductive support 18, the operation of the light sources in the line of exit indicators will not be affected.

Having described the invention, what is claimed as new is:

1. An emergency guidance system comprising a support formed from a non-conductive material flexible enough to be formed into a roll so that the support can bend around the walls of corridors or follow a flight of stairs, said support having opposed surfaces, a plurality of electric circuits electrically connected to each other mounted on one surface of said support in spaced relationship to each other, the opposite surface of said support covered by an adhesive, each electric circuit including a light source, means adapted to connect the light source in each circuit to a main power source whereby the light source in each electric circuit is energized, back up power sources connected to and powered by said main power source, each back up power source mounted on said one surface and connected to each light source so that each light source in each electric circuit is independent of the main power source in the event of a failure in the main power source.

2. The emergency guidance system described in claim 1 including means associated with said adhesive for permitting the support roll to be easily unrolled without stressing the electric surfaces on the surface opposite said adhesive.

* * * * *